United States Patent [19]

Iwata et al.

[11] Patent Number: 4,820,905

[45] Date of Patent: Apr. 11, 1989

[54] CARBONIZING FURNACE

[75] Inventors: Yoshikazu Iwata; Makoto Sugiyama; Motohisa Miyauchi, all of Shizuoka, Japan

[73] Assignee: Toho Rayon Co., Ltd., Tokyo, Japan

[21] Appl. No.: 71,448

[22] Filed: Jul. 9, 1987

[30] Foreign Application Priority Data

Jul. 9, 1986 [JP] Japan ..... 61/159587

[51] Int. Cl.[4] ..... H05B 3/64

[52] U.S. Cl. ..... 219/390; 219/388

[58] Field of Search ..... 219/390, 388, 388 S, 219/553, 343; 432/8, 59

[56] References Cited

U.S. PATENT DOCUMENTS

| | | | |
|---|---|---|---|
| 2,823,292 | 2/1958 | Kunzle | 219/388 S |
| 3,361,863 | 1/1968 | Lang | 219/390 |
| 3,641,249 | 2/1972 | Higgins | 219/388 S |
| 3,870,468 | 3/1975 | Neti | 219/553 |
| 4,167,915 | 9/1979 | Toole | 219/343 |
| 4,451,926 | 5/1984 | Hogg | 373/93 |
| 4,517,448 | 5/1985 | Crain | 219/390 |

FOREIGN PATENT DOCUMENTS

| | | | |
|---|---|---|---|
| 581097 | 8/1958 | Italy | 219/388 S |
| 1466999 | 3/1977 | United Kingdom | 219/390 |

*Primary Examiner*—Teresa J. Walberg

*Attorney, Agent, or Firm*—Sughrue, Mion, Zinn, Macpeak & Seas

[57] ABSTRACT

A carbonizing furnace includes a heating chamber with a wall having channels therein, a carbon heater in the channels, a heat insulator composed of carbon fiber felt and a ceramic fiber felt which covers the heating chamber such that the carbon fiber felt is in contacting with the heating chamber and the ceramic fiber felt is separated by a space from the carbon fiber felt, and a housing enclosing the heating chamber and the heat insulator, and an inlet for filling the insulator with an inert gas. The carbonizing furnace can be run stably and continuously.

10 Claims, 3 Drawing Sheets

CARBONIZING FURNACE

FIELD OF THE INVENTION

This invention relates to a carbonizing furnace. More particularly, it relates to a carbonizing furnace suitable for carbonizing materials in continuous lengths, such as filaments, felt, etc.

BACKGROUND OF THE INVENTION

Production of bundles, fabrics, felts, etc. of carbon fibers has been conducted by continuously carbonizing precursors that have been previously rendered heat resistant, in an inert gas at a temperature above 500° C. Many apparatuses for production have a tubular heating chamber providing a path through which the precursor is carried while being heated.

Apparatuses for continuously producing carbon fibers are known in which a carbon fiber precursor passes through a tubular heating chamber which is vertically set and externally heated, as described in Japanese patent application (OPI) Nos. 116224/76 (corresponding to U.S. Pat. Nos. 4,073,870) and 119834/76 (the term "OPI" as used herein means an "unexamined published Japanese Patent application"). Heaters commonly used in this type of apparatus include a resistive heating system and an induction heating system.

In these carbonizing furnaces, alumina fiber felt, ceramic felt, carbon black or carbon particles have been widely employed as heat insulating materials (heat insulators).

Such conventional carbonizing furnaces have the following problems.

(1) Carbon black or carbon particles, when used as a heat insulator around a heating chamber, can form a conductive path across electrical insulation, which leads to a breakdown.

(2) The carbon black and carbon particles are difficult to handle.

(3) Alumina/silica type ceramic fiber felt which has heat resistance (for using at least six months continuously) at a temperature not higher than, for example, 1500° C. cannot be used as a heat insulator for carbonizing furnaces where heat treatment is effected at temperatures higher than 1800° C. because fibers gradually shrink.

(4) Carbon fibers coiled around a heating chamber as a heat insulator exhibit higher heat resistance than the ceramic fiber felt when heat treatment is effected at 1800° C. or higher. However, carbon fibers are difficult to handle and very expensive.

(5) Carbon felt, when used as a heat insulator in a conventional carbonizing furnace, scatters short fibers that can form an electrically conductive path, and cause shortcircuiting.

SUMMARY OF THE INVENTION

An object of this invention is to eliminate the above-described problems associated with the conventional techniques and to provide a carbonizing furnace which can be run continuously at a higher temperature than that in the case of the conventional techniques, and stably for an extended period of time, without a sudden stop due to short-circuiting caused by a conductive heat insulator.

It has now been found that the above object can be accomplished by a carbonizing furnace having a heating chamber with a wall having channels therein, a heating means in the channels, a heat insulator composed of carbon fiber felt and a ceramic fiber felt which covers the heating chamber in such a manner that the carbon fiber felt is in contact with the heating chamber and the ceramic fiber felt is separated by a space from the carbon fiber felt, a housing enclosing the heating chamber and the heat insulator, and a means for filling the insulator with an inert gas.

By the use of the carbonizing furnace according to the present invention, desired treating temperatures even at about 1800° C. can be assured stably and for a long period of time even when a ceramic fiber felt which has heat resistance at a temperature of about 1500° C. is used, and sudden breakdowns caused by the scattering of short fibers can be avoided.

BRIEF DESCRIPTION OF THE ACCOMPANYING DRAWINGS

Figure 5A:
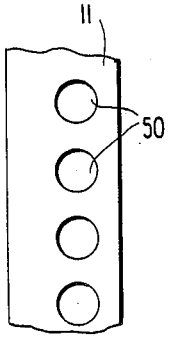
Figure 5B:
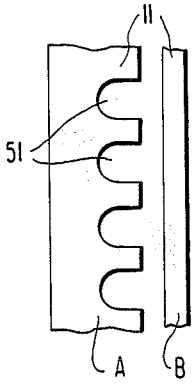
Figure 5C:
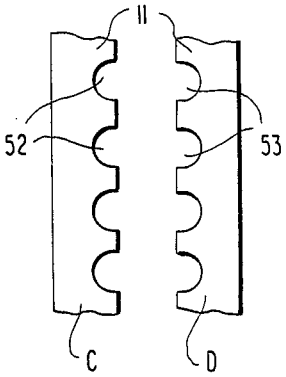

FIGS. 5-*a*, *b* and *c* show cross section of the portion where the channel is provided in the wall of the heating chamber according to the present invention.

DETAILED DESCRIPTION OF THE INVENTION

The heating chamber of the carbonizing furnace according to the present invention is preferably made of graphite of various grades appropriated selected according to running temperature. In particular, graphite having a density of from about 1.60 g to 1.80 g/cm$^3$, obtained by processing carbon at a high temperature such as about 3000° C. is preferred because of reduced consumption of oxidation during long runs.

The heating chamber may be monolithically molded but, in general, it is preferably constructed by longitudinally joining cylindrical or rectangular parts both for convenience of production of the furnace and mechanical strength.

The channels in the wall of the heating chamber should provide enough space to contain a heating means therein and are preferably continuous within the heating chamber wall. In order to control the temperature distribution along the longitudinal direction of the furnace, the channels are usually provided substantially transverse to the longitudinal direction of the chamber. The channels may be provided so that the heater can be wound spirally in the wall of the chamber continuously through a zone having a definite temperature.

The channels can be provided by drilling (see FIG. 5-*a*). Alternatively, the channels in the chamber wall may be formed by joining an inner part and an outer part of the chamber separated in the longitudinal direction, at least one of which has grooves such that when the inner part and the outer part are joined to each other channels are formed by the grooves (see FIGS. 5-*b* and *c*). These two parts are advantageously made of the same material used for the heating chamber, to prevent cracks due to differences in thermal expansion.

The heating means introduced into the channels is suitably a conventional electrically resistive heater, and is not particulary limited. In the present invention it is preferable to use a carbon heater. The insulator which can be used for fixing the heater in the channel is not particularly limited as long as it has sufficient heat resistance in the working range. For example, ceramics, such as boron nitride, are preferred.

In the present invention, a combination of two kinds of heat insulating materials is used as a heat insulator; one of which comprises carbon fiber felt, and the other of which comprises ceramic fiber felt.

For production of carbon fiber felt, carbon fibers preferably having a filament diameter of about 5 to 25μm are used. In order to prevent the heat insulator from contamination with decomposition gases formed by decomposition of the carbon fibers, the carbon fiber felt preferably contains carbon fibers having a carbon content of about 90% by weight or more. Such fibers can be obtained according on methods described in, for example, U.S. Pat. Nos. 3,682,595 and 4,032,607.

An average carbon fiber length in the felt is preferably from about 30 to 500mm. The carbon fiber felt used preferably has a bulk density of about 0.06 to 0.16 g/cm$^3$, more preferably, from about 0.1 to 0.13 g/cm$^3$. If the bulk density is less than about 0.06 g/cm$^3$ or more than about 0.16 g/cm$^3$, the heat insulation performance is so poor that the thickness of the insulating layer must be increased to produce the desired insulating effect, resulting in an undesirable increase of size of the apparatus.

The thickness of the carbon fiber felt is suitably determined depending on the temperature in the heating chamber, the distance between the carbon fiber felt and the ceramic fiber felt, and the heat resistance of the ceramic fiber felt. Usually, it is preferable that the surface of the aforesaid ceramic fiber felt not be exposed to a temperature higher than about 1500° C., and more preferably about 1000° C. when it is used for a long period of time. Generally it is preferable that the carbon fiber felt have a thickness of from about 50 to 250 mm.

Ceramic fibers which are used in the ceramic fiber felt in the present invention mainly are composed of alumina and silica. Commercially available fiber usually contain impurities such as $Fe_2O_3$, $TiO_2$, MgO, CaO, $B_2O_3$, $ZrO_3$, etc. Ceramic fibers having a higher purity and a higher weight ratio of alumina in the alumina/silica type ceramic are preferably used as a heat insulator for insulating a higher temperature.

A suitable ceramic fiber which is commercially available contains alumina in an amount of from about 36 to 100% by weight based on the total weight of the ceramic fiber.

The filament diameter of the above-described ceramic fiber is from about 2 to 5 μm and the fiber length in the felt may be from about 5 (minimum) to 200 (maximum)mm.

The ceramic fiber felt preferably has a bulk density of from about 0.1 to 0.25g/cm$^3$, more preferably, from about 0.13 to 0.16g/cm$^3$for the same reason as described for the carbon fiber felt.

The thickness of the ceramic fiber felt is determined so that the temperature at the outer surface of the housing is lowered to less than about 100° C., preferably, less than about 60° C. Usually, the thickness is from about 200 to 1,000mm.

The carbon fiber felt and the ceramic fiber felt can be produced by any conventional method so long as the fibers in each felt are distributed substantially uniformly and the fiber of each are oriented in substantially random directions. If desired, a binder may also be used in production of the felt.

The carbon fiber felt is placed in contact with the outer surface of the heating chamber. Generally, the carbon fiber felt is encloses the chamber walls. The ceramic fiber felt is placed outside the carbon fiber felt so that a space is provided between the carbon fiber felt and the ceramic fiber felt. The space is provided to increase the heat insulating effect, and the space is effective to prevent heat conduction from the carbon fiber felt to the ceramic fiber felt. The space is especially effective to prevent heat conduction from the carbon fiber felt where superheated. The distance between the carbon fiber felt and the ceramic felt is determined according to the thickness of the carbon fiber felt, the temperature of the heating chamber, and the heat resistance of the ceramic fiber felt. Usually, effective distance is about 5 cm or more, preferably about 30 cm or more for convenient maintenance of the heat insulator, and it may be about 100 cm, if desired.

The outer side of the insulator is covered with a housing made, for example, of a metal such as iron. To prevent of oxidation of the insulator, it is effective to keep the zone between the heating chamber and the housing in an inert gas atmosphere in order to fill the carbon fiber felt and the ceramic felt with the inert gas, such as nitrogen, argon or helium, during running. For this purpose, the apparatus has a conventional means for filling the zone with an inert gas. The apparatus preferably has at least one inert gas inlet in the vicinity of the bottom of the insulator, and at least one outlet in the vicinity of the top of the insulator. At the start of operation of the furnace the air in the heat insulator portion and the space is replaced with the inert gas, exhausting the air from the outlet.

The carbonizing furnace according to the present invention can be utilized for the production of carbon fibers or graphite fibers. In carrying out carbonization, a precursor of carbon fibers, such as acylic fibers, rayon fibers, pitch fibers, etc., in the form of continuous fiber, woven fabric felt, etc. which has been subjected to flameproofing is continuously introduced into the furnace, if desired after having been pre-carbonized to some extent at a lower temperature.

The present invention will now be illustrated in detail and with respect to specific embodiments thereof, by reference to the accompanying drawings, although the present invention is not to be construed as being limited thereto.

Figure 1:
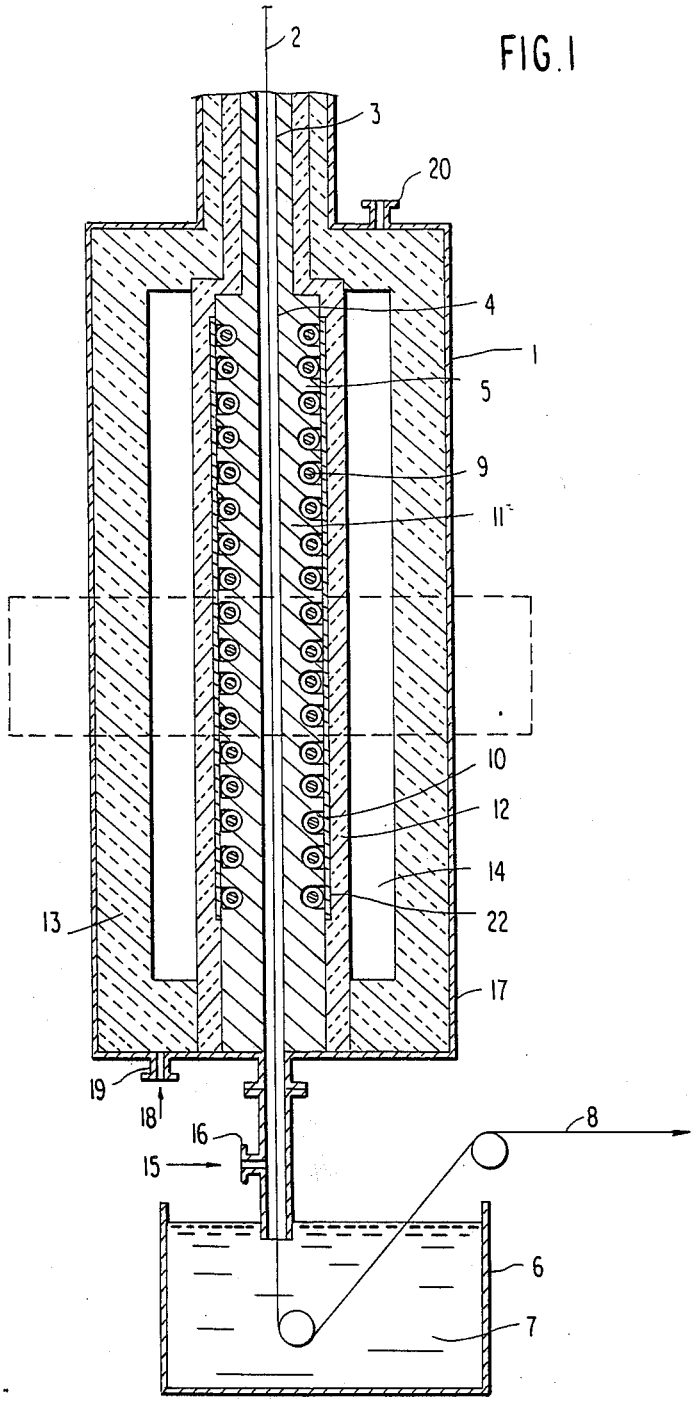
FIG. 1 shows a longitudinal section of a carbonizing apparatus including the carbonizing furnace according to the present invention.

FIG. 1 shows a longitudinal section of an apparatus including carbonizing furnace 1 of the present invention. In FIG. 1, fibrous material 2 is introduced from inlet 3 at the top of the apparatus into treating chamber 4 in heating chamber 5, wherein it is heat-treated and then withdrawn through a sealing mechanism 6 (containing sealing liquid 7) connected to the bottom of the furnace to obtain carbonized product 8. Heating of heating chamber 5 is effected by resistive heating using heater 9 in channel 10 provided in wall 11 of heating chamber 5. The heating chamber is heat-insulated by carbon fiber felt 12 and ceramic fiber felt 13. Between felt 12 and felt 13 space 14 is provided. During the heat treatment an inert gas 15 is fed from a source not shown, into treating chamber 4 by inlet 16. The heat insulating portion in housing 17 where felts 12 and 13 are located and space 14 is provided is also filled with an inert gas 18 through inlet 19. The substitution of air in the insulator portion with the inert gas is conducted by expelling air from outlet 20. Channel 10 is formed by providing grooves in the body of the heater and sealing them by covering 22.

Figure 2:
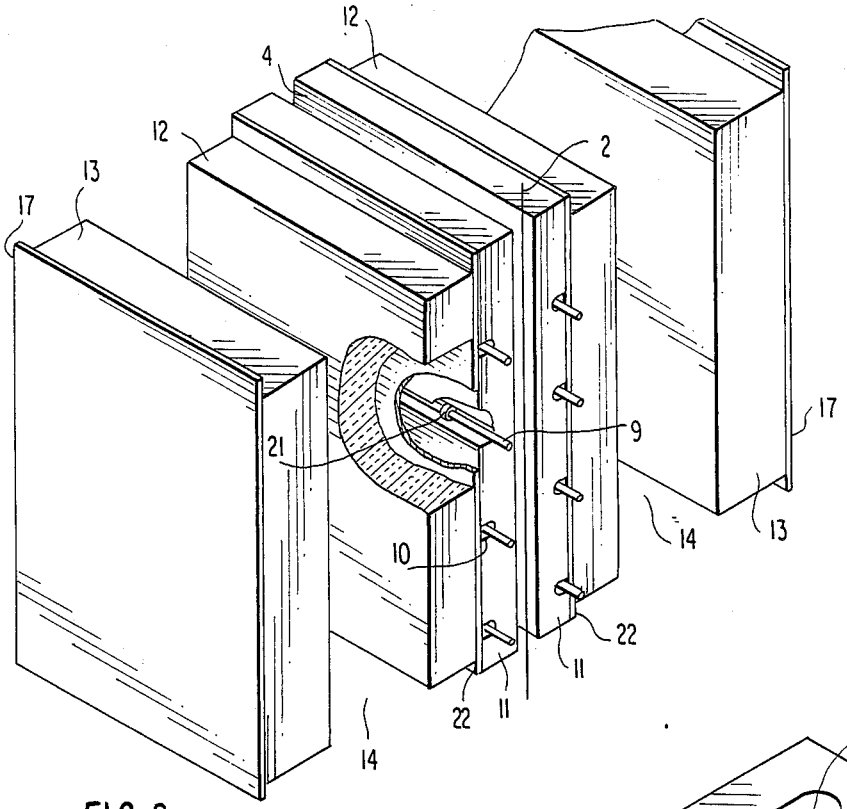
FIG. 2 shows an enlarged perspective view of a part of the carbonizing furnace of FIG. 1.

FIG. 2 shows an enlarged perspective section of the part of FIG. 1 enclosed with a dotted line. In FIG. 2, carbon heater 9 is fixed at a prescribed position in channel 10 of heating chamber 5 and isolated from the channel walls by insulator 21.

The number, the arrangement, pitch, output, etc. of carbon heaters 10 are determined according to the temperature and temperature distribution of the treating chamber.

Heating chamber 5 in FIG. 1 has the construction as shown in FIG. 5-*b*. Covering 22 should be intimately contacted with chamber body forming a heating chamber 5 by an intermesh or the like so that scattered dust of carbon felt may not enter into channels 10.

Figure 3:
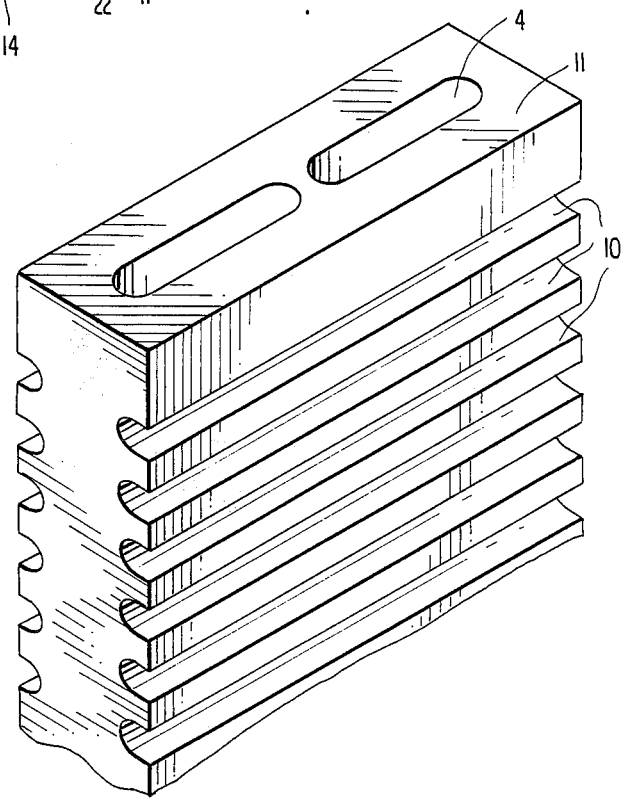
FIG. 3 shows a enlarged perspected view of a part of a heating chamber of a carbonizing furnace of FIG. 1.

FIG. 3 shows a perspective view of a part of heating chamber 5 of the apparatus shown in FIG. 1.

Figure 4:
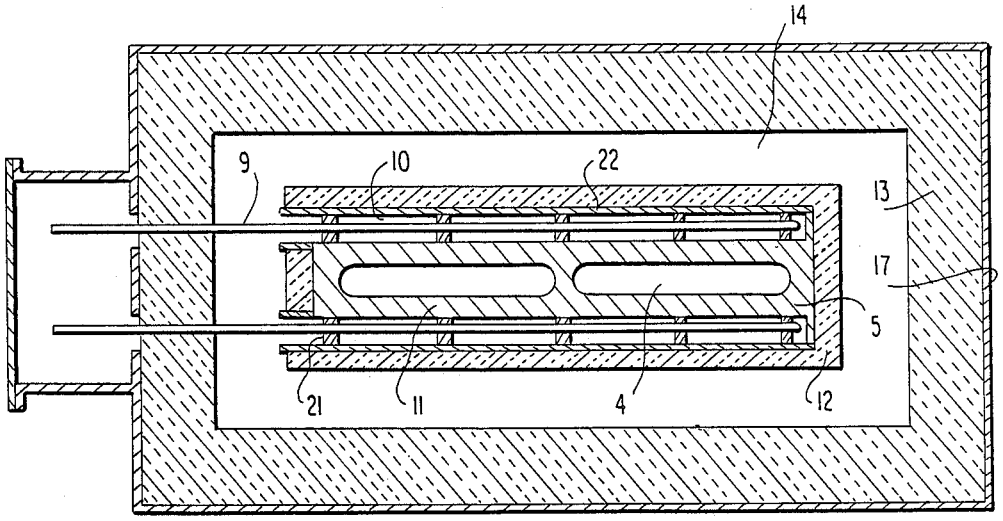
FIG. 4 shows a cross section of the carbonizing furnace of FIG. 1.

FIG. 4 shows a cross section of the carbonizing furnace 1 in FIG. 1.

FIG. 5-*a*, *b* and *c* show longitudinal sections of walls of heating chamber according to the present invention. The channels 50 in FIG. 5-*a* were provided by drilling the wall of the heating chamber. The construction of the wall shown in FIG. 5-*b* is the same as wall 11 in FIG. 1, which comprises part A having grooves 51 and part B which acts as a covering for the grooves to form channels. In FIG. 5-*c*, the wall is separated in two parts C and D in the longitudinal direction. Both of them have grooves 52 and 53 which form channels when part C and part D are joined.

In view of long-lasting heat insulation effects, it is necessary that the heat insulator made up of carbon fiber felt 12 and ceramic fiber felt 13 have a space 14 therebetween. If felt 12 and felt 13 are in intimate contact with each other, felt 13 is heated by the heat conducted through felt 12. As a result, the bulk density of felt 13 gradually increases, which leads to gradual reduction in heat insulation properties.

In carrying out carbonization, the carbonizing furnace may be installed laterally so that a fibrous material travels in a transverse direction, but it is preferably installed vertically whereby a fibrous material runs vertically, from considerations of operating ease and simplicity of design of the apparatus. In the latter case, a fibrous material to be treated is introduced to the treating chamber from a top opening, treated under predetermined conditions (i.e., temperature, retention time, etc.,) and then withdrawn from an outlet at the bottom. During the treatment, the fibrous material and the inert gas in counter-current flow contact each other in the treating chamber to thereby remove decomposition gases. The inert gas is preferably introduced into the treating chamber from the lower side of the chamber, and particularly from the vicinity of the outlet for the withdrawal of the treated product. It is also possible for the introduction and discharge of the inert gas with decomposition gases to be perfomed batch-wise in several divided portions as described in U.S. Pat. 4,543,241.

According to the present invention, since ceramic fiber felt used as a heat insulating material is not deteriorated by oxidation or shrinking, exchange of the insulator is infrequently or never required and the apparatus can be used for a prolonged period of time. Further, since the heater is enclosed in the wall of the heating chamber, heating of the heating chamber can not only be conducted rapidly but also be controlled within a narrow temperature distribution. If the heater were fixed to the outer surface of the heating chamber, the heating zone of the heating chamber would be broadened, making it difficult to locally control the temperature distribution. Any difficulty in temperature control can be eliminated by the present invention.

EXAMPLE 1

A strand (containing 12,000 filaments) of fibers prepared from a copolymer (molecular weight: about 70,000) consisting of 98% by weight of acrylonitrile and 2% by weight of methylacrylate, and having an individual filament fineness of 0.9 denier was preoxidized in the air at 265° C. for 0.38 hour, at 275° C. for 0.20 hour and at 283° C. for 0.15 hour under a tension of 60mg/d. The thus obtained preoxidized fibers contained bonded-oxygen in an amount of 9.8% by weight.

The thus obtained fibers were carbonized using an apparatus shown in FIG. 1. The density of graphite used as a material for heating chamber 5 was 1.60g/cm$^3$, insulator 21 was made of boron nitride, the material of covering 22 was the same as the above-described graphite, carbon fiber felt 12 was prepared by needle punching carbon fiber tows obtained from pitch and having carbon content of 99% by weight. The carbon fiber felt had a brlk density of 0.1g/cm$^3$, an average filament diameter of 14.5$\mu$m, an average filament length of 300mm, and a thickness of 180mm, space 14 was 300mm, ceramic fiber felt 13 was an alumina fiber felt having a bulk density of 0.15g/cm$^3$ and thickness of 600mm prepared by using alumina fibers having an filament diameter of not more than 3$\mu$m and an average filament length of 20mm. The ceramic fiber felt was contacted to hausing 17 made from iron. Sealing liquid 7 was water, and as inert gases 15 and 18 nitrogen gas was used. The wall of heating chamber 5 was divided to three temperature zones heating by carbon heaters. The temperatures of the wall at the uppermost zone, the middle zone and the lowermost zone were 900° C., 1,400° c., and 1800° C. respectively.

The temperature of the inner surface of ceramic fiber felt 13 (facing space 14) of the lowermost zone was 1340° C. and the temperature of the outer surface of the housing was 55° C.

The preoxidized fiber was fed into inlet 3 and withdrawn from sealing mechanism 6 taking 3 minutes taking one minute for passing through each of tree zones. The thus obtained carbon fiber had a tensile strength of 400Kgf/mm$^2$ and a tensile modulus of elasticity of $30\times10^3$Kgf/mm$^2$.

Even though the carbonization was conducted continuously for 3,500 hours the temperature of the housing did not rise.

While the invention has been described in detail and with reference to specific embodiments thereof, it will be apparent to one skilled in the art that various changes and modifications can be made therein without departing from the spirit and scope thereof.

What is claimed is:

1. A carbonizing furnace comprising a heating chamber for carbonizing fibers, which comprises a wall having channels therein, a carbon heater in the channels, a heat insulator composed of carbon fiber felt and a ceramic fiber felt which covers the heating chamber such that the carbon fiber felt is in contact with the heating chamber and the ceramic fiber felt is separated by a space from the carbon fiber felt by a distance of at least about 5 cm, and a housing enclosing the heating chamber and the heat insulator, and a means for filling the insulator with an inert gas.

2. A carbonizing furnace as claimed in claim 1, wherein said carbon felt has a bulk density of about 0.06 to 0.16 g/cm$^3$.

3. A carbonizing furnace as claimed in claim 1, wherein said carbon felt comprises carbon fibers having a carbon content of at least about 90% by weight.

4. A carbonizing furnace as claimed in claim 1, wherein said ceramic fiber felt comprises an alumina/-silica ceramic fiber.

5. A carbonizing furnace as claimed in claim 4, wherein said ceramic fiber felt contains alumina in an amount of from about 36 to 100% by weight based on the total weight of the ceramic fiber.

6. A carbonizing furnace as claimed in claim 1, wherein the thickness of the carbon fiber felt is from about 50 to 250mm.

7. A carbonizing furnace as claimed in claim 1, wherein the thickness of the ceramic fiber felt is determined so that the temperature of the outer surface of the housing is lowered to less than about 100° C.

8. A carbonizing furnace as claimed in claim 1, wherein the thickness of the ceramic fiber felt is from about 200 to 1,000 mm.

9. A carbonizing furnace as claimed in claim 1, wherein the distance between the carbon fiber felt and the ceramic fiber felt is determined so that the temperature of the outer surface of the housing is lowered to less than about 100° C.

10. A carbonizing furnace as in Claim 1, wherein the housing is comprised of at least a top portion and a bottom portion and wherein said housing has an inert gas inlet in the vicinity of a bottom portion of the insulator and a gas outlet in the vicinity of a top portion of the insulator.

* * * * *